United States Patent [19]

Jacobson

[11] 4,446,619

[45] May 8, 1984

[54] RAZOR HANDLE

[75] Inventor: Chester F. Jacobson, Southboro, Mass.

[73] Assignee: The Gillette Company, Boston, Mass.

[21] Appl. No.: 385,905

[22] Filed: Jun. 7, 1982

[51] Int. Cl.[3] ..... B26B 21/14

[52] U.S. Cl. ..... 30/85; 30/47; 30/64

[58] Field of Search ..... 30/85, 87, 89, 64, 47, 30/53

[56] References Cited

U.S. PATENT DOCUMENTS 3,644,992 2/1972 Bennett et al. ..... 30/64 X 3,646,674 3/1972 Fitzpatrick ..... 30/64

3,815,227 6/1974 Hood ..... 30/64

3,918,155 11/1975 Atkins ..... 30/47

*Primary Examiner*—E. R. Kazenske

*Assistant Examiner*—Willmon Fridie, Jr.

*Attorney, Agent, or Firm*—Scott R. Foster

[57] ABSTRACT

A razor handle comprising a grip portion, a neck portion, a connector at a free end of the neck portion for connecting a shaving unit to the handle, and a pusher member molded integrally with the handle and movable in response to pressure applied thereon by an operator to cause a free end of the pusher member to bear against a shaving unit disposed on the connector to dislodge the shaving unit from the connector.

2 Claims, 5 Drawing Figures

RAZOR HANDLE

BACKGROUND OF THE INVENTION

1. Field of the Invention

The invention relates to wet shaving systems, and is directed more particularly to a razor handle suitable for use in such a system.

2. Description of the Prior Art

In U.S. patent application Ser. No. 352,150 there is disclosed a shaving cartridge having a unique and improved means for interconnecting with a razor handle.

In U.S. patent application Ser. No. 352,146 there is disclosed a handle suitable for use with the Ser. No. 352,150 shaving cartridge, the handle being adapted for connection to the shaving cartridge and the combination of handle and cartridge being disposable as a unit.

SUMMARY OF THE INVENTION

An object of the present invention is to provide a handle similar to the Ser. No. 352,146 handle but having means for removing a spent shaving cartridge and being reusable with a subsequently attached new shaving cartridge.

With the above and other objects in view, as will hereinafter appear, a feature of the present invention is the provision of a razor handle comprising a grip portion, a neck portion continuous with one end of the grip portion, a connector means at a free end of the neck portion for connecting a shaving unit to the handle, and a pusher member molded integrally with the handle proximate the neck portion and movable in response to pressure applied thereon by an operator to cause a free end of the pusher member to bear against a shaving unit disposed on the connector means to dislodge the shaving unit from the connector means.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
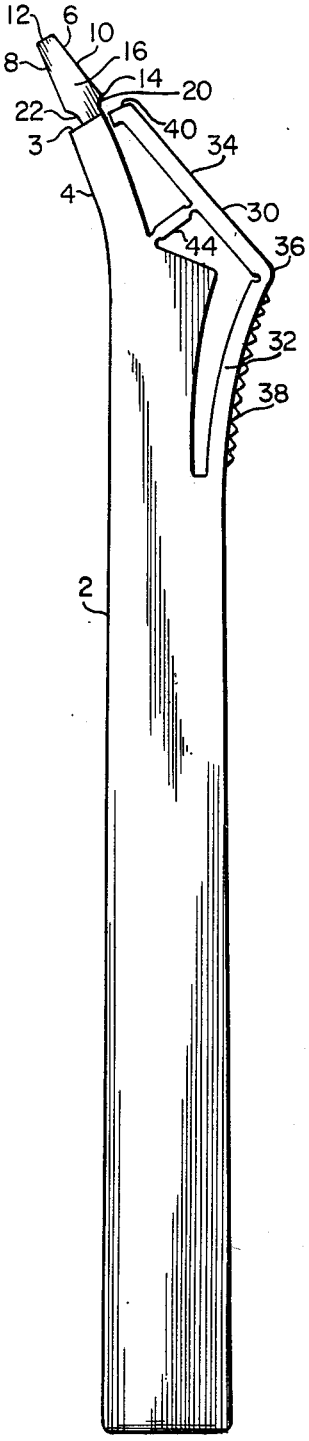
FIG. 1 is a side elevational view of one form of razor handle illustrative of an embodiment of the invention.
Figure 2:
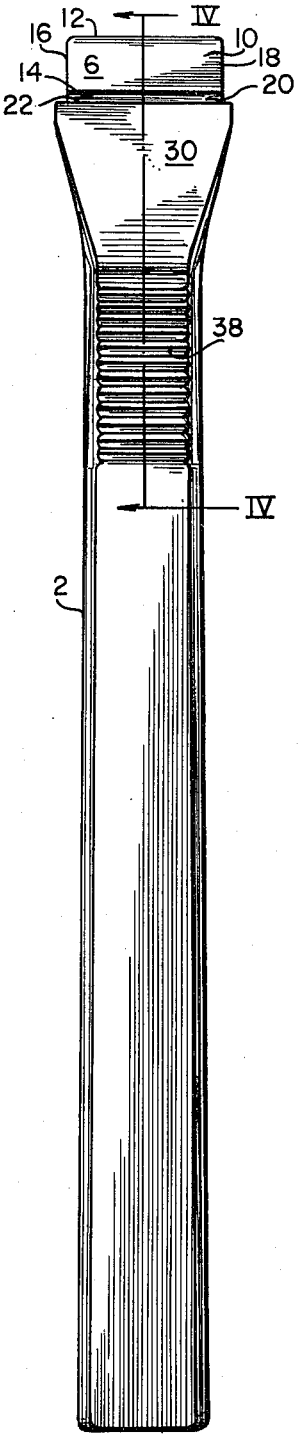
FIG. 2 is a rear elevational view thereof.
Figure 3:
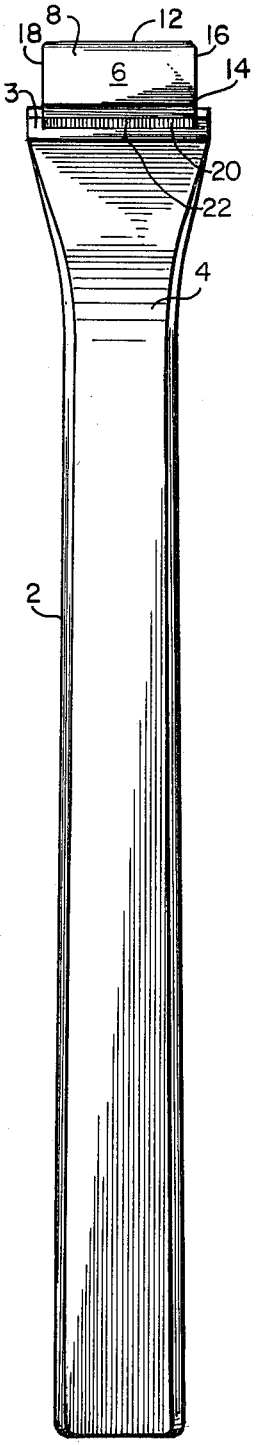
FIG. 3 is a front elevational view thereof.

Referring to the drawings, it will be seen that the illustrative razor handle includes an elongated grip portion 2 and a neck portion 4 extending from one end of the grip portion and disposed at an angle to the grip portion.

Extending from an end 3 of the neck portion 4 remote from the grip portion 2 is a protrusion 6. The protrusion 6 has first and second major planar surfaces 8, 10 extending from a free end 12 of the protrusion, at which the surfaces 8, 10 are closest to each other, to a base portion 14, at which the surfaces 8, 10 are farthest apart. Substantially wedge-shaped end walls 16, 18 interconnect the surfaces 8, 10 along the side edges of the surfaces.

A connecting web 20 joins the base portion 14 of the protrusion 6 to the end 3 of the neck portion 4, the connecting web being of lesser thickness than the protrusion base portion, to provide recess means 22 between the end 3 of the neck portion 4 and the protrusion base portion 14.

The protrusion 6 is in substantial alignment with the neck portion 4, extending outwardly at an angle to the grip portion 2.

Figure 4:
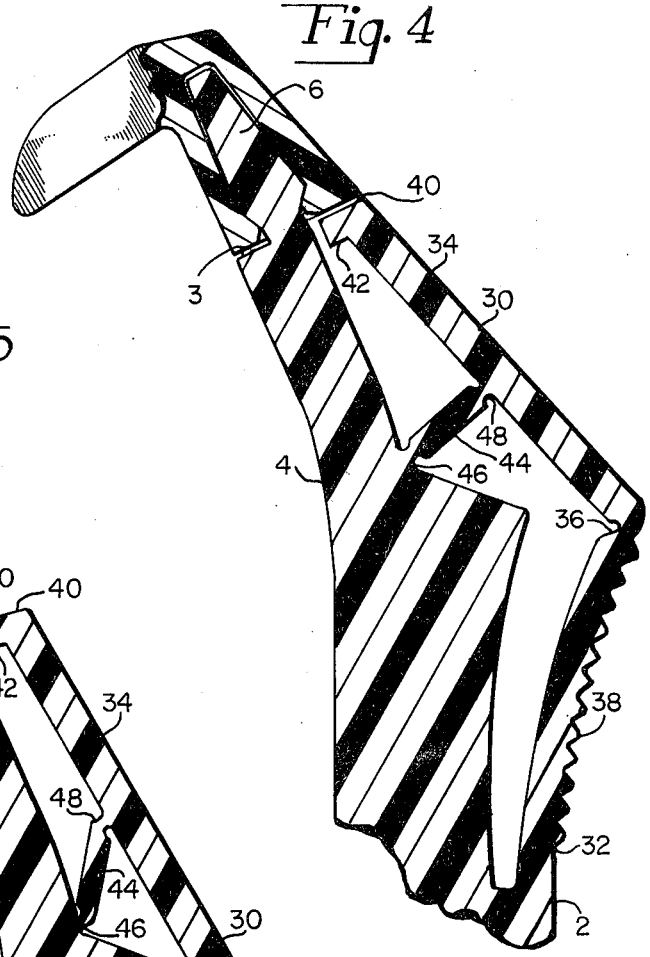
FIG. 4 is an enlarged sectional view of a portion thereof, taken along line IV—IV of FIG. 2; and with an illustrative shaving cartridge shown in position on the razor.
Figure 5:
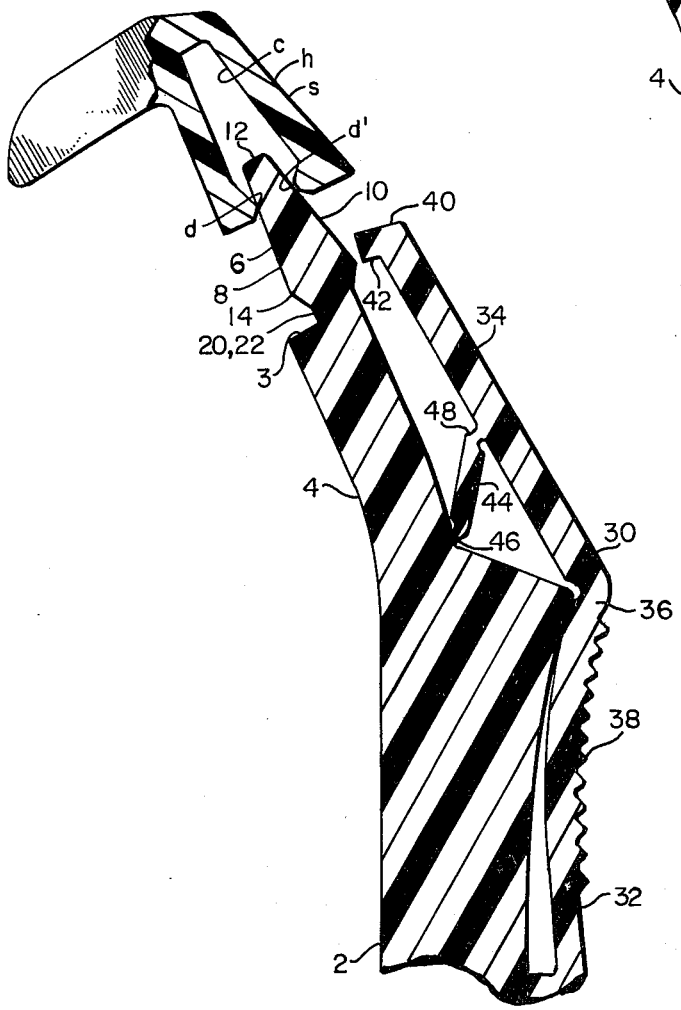
FIG. 5 is similar to FIG. 4 but shows an operative portion of the handle in a position in which the shaving cartridge is dislodged from the razor.

Referring particularly to FIGS. 4 and 5, it will be seen that the illustrative razor handle includes a pusher member 30 proximate the neck portion 4 and molded integrally with the grip portion 2. The pusher member 30 includes a first leg 32 extending from the grip portion, and a second leg 34 overlying the neck portion 4. The first and second legs 32, 34 are interconnected by an integrally molded hinge 36, and are disposed at an angle a to each other. The first leg 32 is provided with a pusher surface 38 adapted to receive the thumb of an operator holding the grip portion of the razor. The second leg 34 has a free end 40 which, when the pusher member is "at rest" is (FIG. 4) is substantially coincident with the free end 3 of the neck portion 4. The free end 40 is preferably enlarged, as by a ledge portion 42. The second leg 34 is further anchored to the handle by an integrally molded bridge portion 44 having near either end thereof hinge portion 46, 48 which permit movement of the bridge portion 44, and thereby the second leg 34 of the pusher member 30.

In use, the protrusion 6 is introduced into a cavity c, defined by a housing portion h of a shaving cartridge s, the housing portion h having inwardly directed opposed detents d, $d^1$. The widest portion of the base portion 14 overrides the detents d, $d^1$, which snap into the recess means 22 to fasten the shaving cartridge s on the handle.

To remove a spent cartridge, an operator need only apply pressure on the pusher surface 38 which is readily accessible from the grip portion 2 of the handle. Pressure so applied causes the pusher member 30 to move from the position shown in FIG. 4 to the position shown in FIG. 5, the hinges 36, 46, 48 flexing to permit such movement. The free end 40, 42 engages an edge portion of the shaving cartridge housing and dislodges the cartridge from the protrusion 6, freeing the protrusion for acceptance of another shaving cartridge.

Upon release of the pusher surface 38, the pusher member 30 returns substantially to its rest position. Attachment of a new cartridge to the handle serves to insure that the pusher member is fully returned to the postion shown in FIG. 4.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A razor handle comprising a grip portion, a neck portion continuous with one end of said grip portion and extending at an angle to said grip portion, a fixed protrusion extending substantially axially from an end of said neck portion for connecting a shaving unit to said handle, and a pusher member molded integrally with said handle proximate said neck portion, said pusher member having first and second legs disposed at an angle to each other and joined by an integrally molded flexible hinge, said first leg extending from said grip portion and said second leg overlying said neck portion, said pusher member having a free end substantially coincident with a free end of said neck portion, said first leg having a pusher surface thereon, said pusher member being movable in response to pressure applied to said pusher surface by an operator to cause said free end of said pusher member to move in a direction substantially parallel with an axis of said neck portion to engage a shaving unit disposed on said protrusion to force said shaving unit axially of said protrusion and off said protrusion.

2. The razor handle in accordance with claim 1 in which said second leg of said pusher member is connected to said neck portion by an integrally molded bridge portion hingedly movable at both ends thereof.

* * * * *